US009630336B2

(12) United States Patent
Schnell et al.

(10) Patent No.: US 9,630,336 B2
(45) Date of Patent: Apr. 25, 2017

(54) PORTABLE POWER TOOL

(75) Inventors: Pascal Schnell, Baerschwil (CH); Hermann Schaible, Biberist (CH)

(73) Assignee: Robert Bosch GmbH, Stuttgart (DE)

( * ) Notice: Subject to any disclaimer, the term of this patent is extended or adjusted under 35 U.S.C. 154(b) by 1221 days.

(21) Appl. No.: 13/606,062

(22) Filed: Sep. 7, 2012

(65) Prior Publication Data

US 2013/0240088 A1 Sep. 19, 2013

(30) Foreign Application Priority Data

Sep. 7, 2011 (DE) ..... 10 2011 082 219

(51) Int. Cl.
*B27C 5/10* (2006.01)
*B25F 5/02* (2006.01)

(52) U.S. Cl.
CPC ..... *B27C 5/10* (2013.01); *B25F 5/021* (2013.01)

(58) Field of Classification Search
CPC .. B23Q 9/0007; B23Q 9/0014; B23Q 9/0028; Y10T 409/306384; Y10T 409/306496; B27C 5/10; B27C 1/005; B27C 1/02; B27C 1/14; B27C 7/00; B27C 7/04; B27C 7/06
See application file for complete search history.

(56) References Cited

U.S. PATENT DOCUMENTS 6,443,675 B1 * 9/2002 Kopras ..... B25F 5/02 144/136.95
6,474,378 B1 * 11/2002 Ryan ..... B27C 5/02 144/136.95
7,066,627 B1 * 6/2006 Chen ..... B23D 59/003 362/259
7,946,906 B2 * 5/2011 Gifford ..... B23D 59/003 125/13.01
2005/0232719 A1 10/2005 Onose et al.
2006/0112581 A1 * 6/2006 Nortmann ..... B23D 59/002 33/638
2008/0295918 A1 * 12/2008 Chung ..... B23Q 17/2404 144/154.5
2009/0188584 A1 7/2009 Stepp
2011/0011229 A1 * 1/2011 Lawlor ..... B23D 45/044 83/100

FOREIGN PATENT DOCUMENTS

| | | | | |
|---|---|---|---|---|
| CN | 2693390 Y | | 4/2005 | |
| CN | 1749022 A | | 3/2006 | |
| CN | 201020762 Y | | 2/2008 | |
| CN | 101204750 A | | 6/2008 | |
| CN | 201220438 Y | | 4/2009 | |
| CN | 101642829 A | | 2/2010 | |
| DE | 38 24 200 C1 | | 8/1993 | |
| GB | 2 453 532 A | | 4/2009 | |
| GB | 2453532 A | * | 4/2009 | ..... B27C 5/10 |
| JP | 11044535 A | | 2/1999 | |

* cited by examiner

*Primary Examiner* — Matthew G Katcoff

(74) *Attorney, Agent, or Firm* — Maginot, Moore & Beck LLP

(57) ABSTRACT

A portable power tool includes at least one drive unit configured to drive an insert tool, at least one housing unit in which the drive unit is disposed, and at least one marking unit configured to mark a relative position of a drive axis of the drive unit on a workpiece to be machined. The the marking unit is disposed on the housing unit.

15 Claims, 2 Drawing Sheets

PORTABLE POWER TOOL

This application claims priority under 35 U.S.C. §119 to patent application no. DE 10 2011 082 219.4, filed on Sep. 7, 2011 in Germany, the disclosure of which is incorporated herein by reference in its entirety.

BACKGROUND

There is already known from GB 2 453 532 A a portable power tool, in particular a router, which comprises a drive unit for driving an insert tool, and comprises a housing unit, in which the drive unit is disposed, and comprises a marking unit for marking a relative position of a drive axis of the drive unit on a workpiece to be machined. The marking unit in this case is disposed on a seating unit of the portable power tool. The seating unit is provided for seating on a workpiece.

SUMMARY

The disclosure is based on a portable power tool, in particular a router, comprising at least one drive unit for driving an insert tool, and comprising at least one housing unit, in which the drive unit is disposed, and comprising at least one marking unit for marking a relative position of a drive axis of the drive unit on a workpiece to be machined.

It is proposed that the marking unit is disposed on the housing unit. A "portable power tool" is to be understood here to mean, in particular, a power tool, for machining of workpieces, that can be transported by an operator without a transport machine. The portable power tool has, in particular, a mass of less than 40 kg, preferably less than 10 kg, and particularly preferably less than 5 kg. Particularly preferably, the portable power tool is realized as a router. It is also conceivable, however, for the portable power tool to be of a different design, considered appropriate by persons skilled in the art. The drive unit of the portable power tool is preferably provided to drive in rotation, about the drive axis, an insert tool that can be clamped in a tool receiver of the portable power tool. The drive unit in this case is preferably realized as an electric motor. It is also conceivable, however, for the drive unit to be of a different design, considered appropriate by persons skilled in the art, such as, for example, being designed as a pneumatic motor or as an internal combustion engine. "Provided" is to be understood to mean, in particular, specially designed and/or specially equipped. The housing unit is preferably realized as a motor housing unit or as a milling basket. The motor housing unit can be of a pot-type construction or a shell-type construction. Preferably, the motor housing unit is of a pot-type construction or is a combination of a pot-type construction and a shell-type construction, wherein at least two handle shells are connected to each other by means of connecting elements such as, for example, screws, along a connecting plane that extends through a vertical axis of the portable power tool, in particular a lifting axis of the portable power tool.

The expression "marking unit" is intended here to define, in particular, a unit provided to indicate, in particular to indicate temporarily, to an operator a relative position of the drive axis in relation to a workpiece to be machined, in order to indicate, during machining of a workpiece, a contact point between an insert tool clamped in a tool receiver of the portable power tool and the workpiece, before machining of the workpiece by means of the insert tool. Preferably, the contact point is constituted by a notional center point of the insert tool, about which the insert tool can rotate, along a rotation axis extending through the point, or the contact point is constituted by an incidence point of the drive axis in the case of the drive axis being notionally extended as far as a workpiece surface of a workpiece to be machined. The marking unit is thus provided to indicate to an operator the point at which the insert tool that is clamped in the tool receiver of the portable power tool and that can be driven in rotation about the drive axis by means of the drive unit is incident upon the workpiece in the case of machining of a workpiece, and/or the point at which the insert tool, upon incidence upon a workpiece to be machined, rotates along a rotation axis extending through the point, or the point at which removal of workpiece particles commences in the case of machining of a workpiece by means of the insert tool. The marking unit is preferably disposed on the housing unit. The housing unit in this case surrounds the marking unit, at least partially. The expression "disposed on" is intended here to define, in particular, a disposition of the marking unit relative to the housing unit, the marking unit being fixedly connected to the housing unit, at least via one region, and/or the marking unit, when mounted, being surrounded by the housing unit, at least entirely by at least two sides and, in particular, being disposed in a recess of the housing unit.

The design of the portable power tool according to the disclosure makes it possible, advantageously, to protect the marking unit against mechanical damage, in particular resulting from removed workpiece particles flying around, and, advantageously, to protect it against soiling of the marking unit. Advantageously, therefore, it is possible to achieve a reliable marking of a relative position of the drive axis of the drive unit.

Furthermore, it is proposed that the portable power tool comprises at least one seating unit for seating on a workpiece, the marking unit being disposed on a side of the housing unit that faces toward the seating unit. It is also conceivable, however, for the marking unit to be disposed at a different position on the housing unit considered appropriate by persons skilled in the art. A "seating unit" is to be understood here to mean, in particular, a unit that, during machining of a workpiece by means of the portable power tool, the portable power tool being handled in the correct manner, is seated on the workpiece, in particular with a seating surface of the seating unit, and which is provided to support the portable power tool on the workpiece during machining of the workpiece. Particularly preferably, the seating unit is realized as a sliding pad and/or as a base plate. Advantageously, it is possible to achieve a precise marking of a relative position of the drive axis on a workpiece to be machined, which marking, in particular, is irrespective of a dimension of the seating unit and/or of a geometric configuration of the seating unit. In addition, owing to the marking unit being disposed on the housing unit, it can be ensured, advantageously, that the marking unit remains on the portable power tool, in particular on the housing unit, in the case of changing of the seating unit and/or when the portable power tool has been decoupled from the seating unit. Advantageously, therefore, a high degree of operating convenience can be achieved for an operator of the portable power tool.

Further, it is proposed that the portable power tool comprises at least one guide unit, by means of which the housing unit, together with the marking unit, is mounted so as to be movable relative to the seating unit. The expression "guide unit" is intended here to define, in particular, a unit provided to guide a component in a movement in a plane along a defined path, by exerting at least one constraining force transversely in relation to the direction of movement. Particularly preferably, the guide unit is realized as a linear guide unit, which is provided to guide the housing unit linearly in a movement relative to the seating unit. A "constraining force" is to be understood here to mean, in particular, a force provided to prevent a component from moving in at least one direction and/or to keep the component, during a movement, on a path defined through exertion of the force upon the component. Particularly preferably, the housing unit is guided linearly along a lifting axis of the portable power tool by means of the guide unit. "Movably mounted" is to be understood here to mean, in particular, a mounting of the housing unit, together with the marking unit, by means of the guide unit, wherein the housing unit and the marking unit, in particular decoupled from an elastic deformation of the housing unit and the marking unit, have a capability to move relative to the seating unit, along the lifting axis, along a travel distance greater than 1 mm, preferably greater than 10 mm, and particularly preferably greater than 20 mm Alternatively or additionally, however, it is also conceivable for the housing unit and the marking unit to have a different movement capability relative to the seating unit, by means of the guide unit, considered appropriate by persons skilled in the art, such as, for example, a capability to move about at least one axis, by an angle greater than 10°, preferably greater than 45°, and particularly preferably greater than 60°. Advantageously, by means of the design of the portable power tool according to the disclosure, the marking unit can be moved concomitantly as the housing unit is being moved relative to the seating unit. Advantageously, therefore, it is possible to ensure a precise marking of a relative position of the drive axis of the drive unit on a workpiece to be machined during a movement of the housing unit relative to the seating unit.

In addition, it is proposed that the portable power tool comprises at least one adjusting unit, which has at least one movably mounted adjusting element for adjusting a position of at least one marking element of the marking unit, on which adjusting element the marking element is movably mounted. The adjusting unit is provided, in particular, to set a position of the marking element, relative to the housing unit and relative to the seating unit, along and/or about at least two axes. The marking element in this case is preferably mounted on the adjusting element so as to be rotatable relative to the adjusting element. It is also conceivable, however, for the marking element to be mounted so as to be translationally and/or pivotally movable relative to the adjusting element. The adjusting element is preferably mounted so as to be rotatable relative to the housing unit and to the seating unit. It is also conceivable, however, for the adjusting element to be mounted in a translationally movable manner, in particular for the purpose of compensating an axial offset. The adjusting element is preferably realized as an eccentric element provided, in the case of a rotation relative to the housing element, to move the marking element, movably mounted on the adjusting element, eccentrically in relation to a rotation axis of the adjusting element. It is also conceivable, however, for the adjusting element to be of a different design, considered appropriate by persons skilled in the art, that is provided to compensate an axial offset due to tolerances and/or to mounting. Advantageously, an axial offset due to tolerances and/or to mounting and an angular error due to tolerances and/or to mounting can be compensated.

Advantageously, the adjusting element is movably mounted on a carrier element of the marking unit. A "carrier element" is intended here to mean, in particular, an element that transfers, in particular transfers to the housing unit, bearing forces of the adjusting element and/or of the marking element following a movement of the adjusting element and/or a movement of the marking element. Preferably, the carrier element is fixedly connected to the housing unit by means of connecting elements such as, for example, screws, etc. It is also conceivable, however, for the adjusting element and/or the marking element to be mounted, decoupled from the carrier element, in and/or on the housing unit. Advantageously, it is possible to achieve a compact disposition on the housing unit. Further, advantageously, retrofitting on already existing portable power tools can be realized in a structurally simple manner.

Furthermore, it is proposed that the marking unit has at least one energy conversion unit for operating the marking unit. The term "energy conversion unit" is intended here to define, in particular, a unit provided to convert one form of electrical energy into another form of electrical energy, in particular to convert an alternating current into a direct current and/or to convert an alternating voltage into a direct voltage, and/or to convert, in particular to lower and/or increase, a level of an electrical voltage. Particularly preferably, the energy conversion unit for providing an operating energy for operating the marking unit is provided to convert an alternating current of a mains electric power supply into a direct current. The energy conversion unit is preferably disposed in the housing unit. In addition, the energy conversion unit can preferably be supplied with energy by means of an electrical connection to a power cable of the portable power tool that can be connected to an external power source. The marking unit is thus preferably realized as an electronic marking unit. Advantageously, the marking unit can be supplied with energy by means of an energy supply line already disposed in the housing unit. Advantageously, therefore, it is possible to dispense with a separate energy source for supplying energy to the marking unit.

Advantageously, the energy conversion unit is realized as a switched-mode power supply unit. Preferably, the switched-mode power supply unit is provided to convert a non-stabilized input voltage (direct or alternating voltage) into a direct voltage of a different level. Preferably, in this case, the input voltage is first rectified, converted, for the purpose of transformation, into an alternating voltage of substantially higher frequency and, following transformation, finally rectified again. Inexpensive operation of the marking unit can be achieved.

Particularly, the marking unit is realized as a laser marking unit. The marking unit is thus preferably realized as an optoelectronic marking unit. Advantageously, with little illumination of a workpiece to be machined, a precise and clearly visible marking of a relative position of the drive axis of the drive unit on the workpiece to be machined can be achieved.

Advantageously, the laser marking unit has at least two laser marking elements, which are realized as line lasers. It is also conceivable, however, for the laser marking unit to be of a different design, considered appropriate by persons skilled in the art, such as, for example, being designed as a point laser, whose point-type laser beam is scattered to form a line by means of an optical system of the laser marking unit that is realized separately from the point laser. Owing to a distance of the housing unit and of the marking unit relative to the seating unit, and therefore relative to a workpiece to be machined, and because of the marking unit being disposed on a side of the housing unit that faces toward the seating unit, the design according to the disclosure makes it possible, advantageously, to achieve a fine, uniform image that is clearly visible by an operator, because of a steep angle of incidence of emitted laser beams of the laser marking elements on the workpiece to be machined. In addition, owing to the marking unit being disposed on a side of the seating unit that faces toward the seating unit, it is advantageously possible to prevent an operator from being dazzled by the laser beams. Furthermore, owing to the marking unit being designed as a laser marking unit and owing to the possibility of adjustment by means of the adjusting unit, inexpensive laser marking elements can be used, advantageously, for marking a relative position of the drive axis on a workpiece to be machined.

Particularly preferably, the laser marking elements are disposed along a circumferential direction running in a plane extending at least substantially perpendicularly in relation to the drive axis, offset relative to each other by an angle other than 180° on the housing unit. Preferably, the laser marking elements are disposed along the circumferential direction, offset relative to each other by an angle of 90° on the housing unit. By means of emitted laser beams of the laser marking elements, it is possible to produce on the workpiece to be machined, in a structurally simple manner, a crosshair-type marking that enables an operator, advantageously, to identify with precision a relative position of the drive axis of the drive unit on a workpiece to be machined.

The portable power tool according to the disclosure in this case is not intended to be limited to the application and embodiment described above. In particular, for the purpose of fulfilling a mode of operation described herein, the portable power tool according to the disclosure can have a number of individual elements, components and units that differs from a number stated herein.

BRIEF DESCRIPTION OF THE DRAWINGS

Further advantages are given by the following description of the drawing. The drawing shows an exemplary embodiment of the disclosure. The drawing, the description and the claims contain numerous features in combination. Persons skilled in the art will also expediently consider the features individually and combine them to create appropriate further combinations.

In the drawing.

DETAILED DESCRIPTION

Figure 1:
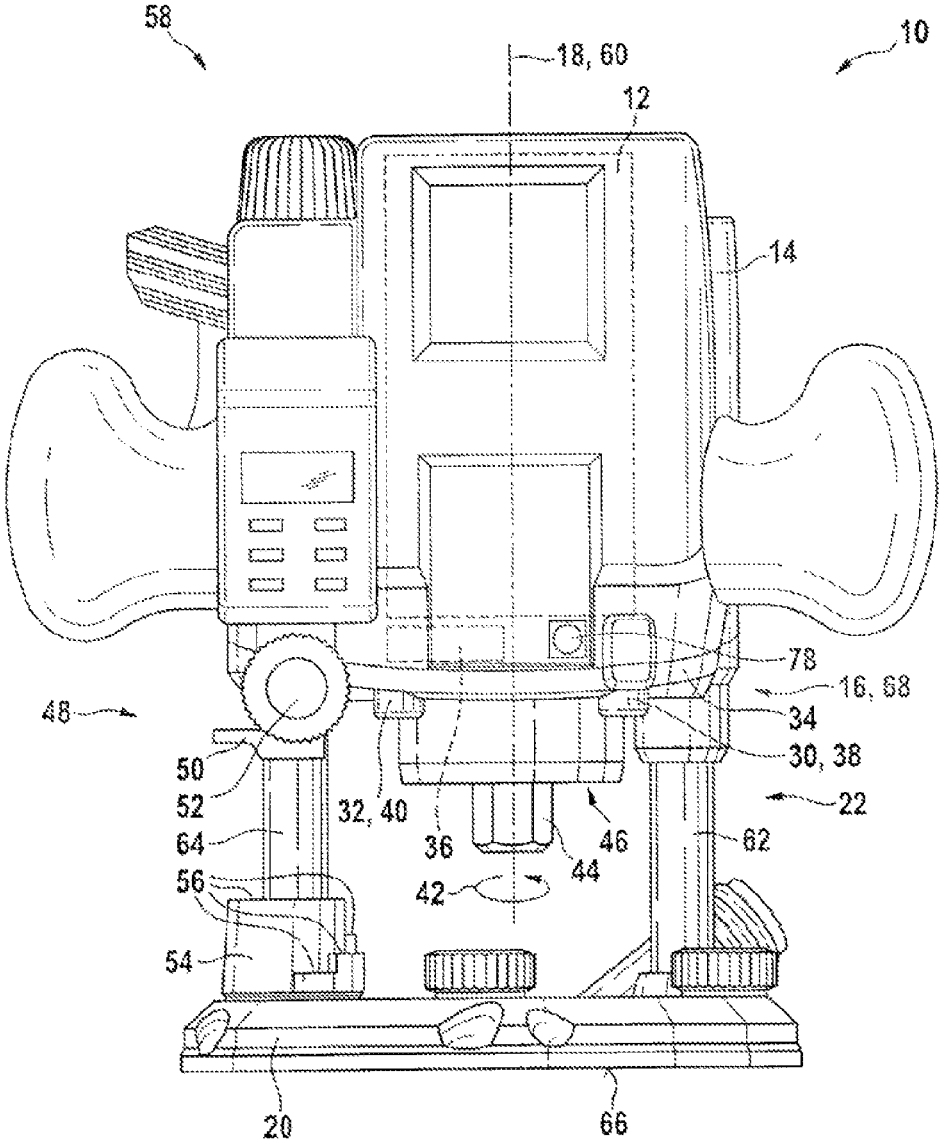
FIG. 1 shows a portable power tool according to the disclosure, in a schematic representation.
Figure 3:
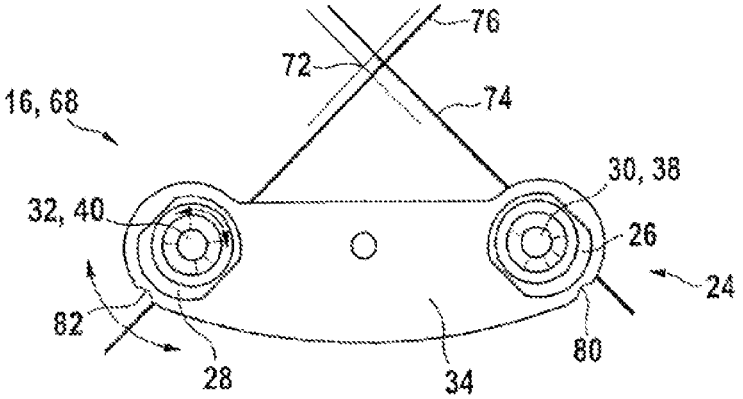
FIG. 3 shows a detail view of the marking unit when demounted from the portable power tool, in a schematic representation.

FIG. 1 shows a portable power tool 10, realized as a router, which comprises a drive unit 12 for driving an insert tool (not represented in greater detail here), a housing unit 14, in which the drive unit 12 is disposed, and a marking unit 16 for marking a relative position of a drive axis 18 of the drive unit 12 on a workpiece to be machined (not represented in greater detail here). The marking unit 16 is disposed on the housing unit 14. The marking unit 16 is fastened to the housing unit 14 by means of a carrier element 34 of the marking unit 16 of the portable power tool 10. In addition, the portable power tool 10 comprises an adjusting unit 24, which has at least one movably mounted adjusting element 26 for adjusting a position of at least one marking element 30 of the marking unit 16, the marking element 30 being movably mounted on the adjusting element (FIG. 3). The marking unit 16 has two marking elements 30, 32 in total. The adjusting unit 24 thus likewise has two adjusting elements 26, 28 in total. The adjusting elements 26, 28 are movably mounted on the carrier element 34 of the marking unit 16. The adjusting elements 26, 28 in this case are realized as eccentric elements, which are rotatably mounted in the carrier element 34. The marking elements 30, 32 are disposed on the eccentric elements, eccentrically in relation to rotation axes of the eccentric elements. The marking elements 30, 32 in this case are rotatably mounted on the eccentric elements.

Further, the portable power tool 10 comprises a seating unit 20 for seating on a workpiece to be machined, the marking unit 16 being disposed on a side 46 of the housing unit 14 that faces toward the seating unit 20. Furthermore, the portable power tool 10 comprises a guide unit 22, by means of which the housing unit 14, together with the marking unit 16, is mounted so as to be rotatable relative to the seating unit 20. In this case, the housing unit 14, together with the marking unit 16, is mounted so as to be linearly movable, relative to the seating unit 20, along a lifting axis 60 of the portable power tool 10. By means of the guide unit 22, the housing unit 14 is mounted so as to be translationally movable, relative to the seating unit 20, along a lifting axis 60 of the portable power tool 10. The guide unit 22 in this case comprises two guide elements 62, 64. The guide elements 62, 64, when mounted, extend at least substantially parallelwise in relation to each other. Further, the guide elements 62, 64, when mounted, extend at least substantially perpendicularly in relation to a seating surface 66 of the seating unit 20, via which the seating unit 20 is seated on the workpiece during machining of a workpiece. The guide elements 62, 64 are fixedly connected to the seating unit 20 by means of a compression connection, in a manner already known to persons skilled in the art. In addition, guide rods (not represented in greater detail here) of the guide unit 22 are disposed in the guide elements 62, 64 in a manner already known to persons skilled in the art. The guide rods are each fixedly connected to the housing unit 14, on a side of the housing unit 14 that faces away from the seating unit 20.

The housing unit 14 of the portable power tool 10 is realized as a motor housing unit, in which the drive unit 12 of the portable power tool 10 is disposed. The drive unit 12 is realized as an electric motor, which is provided to drive in rotation, about the drive axis 18, a tool receiver 44 of the portable power tool 10. The tool receiver 44 is realized as a collet chuck, which is provided to receive the insert tool for machining a workpiece. In addition, the portable power tool 10 comprises a milling depth coarse setting unit 48, which has at least one movement delimitation element 50 for setting a length of a movement travel of the housing unit 14 relative to the seating unit 20. The movement delimitation element 50 is disposed so as to be displaceable at least substantially parallelwise in relation to the drive axis 18. The movement delimitation element 50 in this case can be locked by means of a clamping screw 52 of the milling depth coarse setting unit 48. Further, the milling depth coarse setting unit 48 comprises a revolving stop 54, which is disposed in a rotatable manner on a side of the seating unit 20 that faces toward the housing unit 14 and which, in a known manner, has stop elements 56, which are provided to realize a stop of the movement delimitation element 50 in the case of a movement of the housing unit 14, realized as a motor housing unit, in the direction of the seating unit 20. Furthermore, the portable power tool 10 has a milling depth fine setting unit 58 for fine setting of a characteristic quantity of the portable power tool 10. The characteristic quantity in this case can be constituted by a lifting travel. The fine setting of the characteristic quantity by means of the milling depth fine setting unit 58 is effected in this case by means of a mechanical mechanism already known to persons skilled in the art (cf., for example, DE 38 24 200 C1). The portable power tool 10, realized as a router, is thus at least substantially of a design already known to persons skilled in the art.

Figure 2:
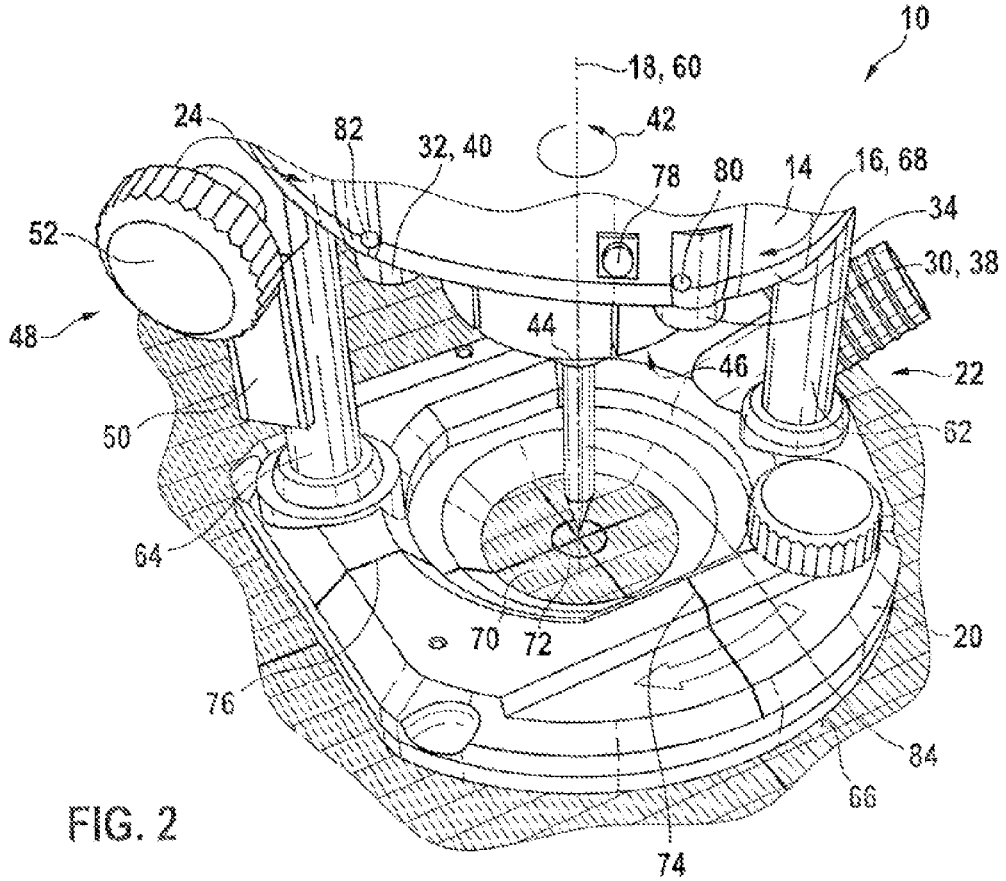
FIG. 2 shows a detail view of a marking unit of the portable power tool according to the disclosure during marking of a relative position of a drive axis of a drive unit of the portable power tool, in a schematic representation.

The marking unit 16 of the portable power tool 10 is provided to indicate to an operator the point at which the insert tool that is clamped in the tool receiver 44 of the portable power tool 10 and that can be driven in rotation about the drive axis 18 by means of the drive unit 12 is incident upon the workpiece in the case of machining of a workpiece, or the point at which removal of workpiece particles commences in the case of machining of a workpiece by means of the insert tool. The marking unit 16 in this case is realized as a laser marking unit 68. The laser marking unit 68 has at least two marking elements 30, 32, realized as laser marking elements 38, 40, which are realized as line lasers (FIG. 2). It is also conceivable, however, for the laser marking unit 68 to comprise a number other than two laser marking elements 38, 40. The laser marking elements 38, 40 are disposed along a circumferential direction 42 running in a plane extending at least substantially perpendicularly in relation to the drive axis 18, offset relative to each other by an angle other than 180° on the housing unit 14. By means of emission of two laser beams 74, 76 of the laser marking elements 38, 40, an intersection point that corresponds to a relative position of the drive axis 18 of the drive unit 12 can be indicated on the workpiece to be machined. The point at which the insert tool that is clamped in the tool receiver 44 of the portable power tool 10 is incident upon the workpiece, in the case of a movement of the housing unit 14, together with the marking unit 16, in the direction of the seating unit 20 for the purpose of machining a workpiece, is thus indicated to an operator.

Further, the marking unit 16, realized as a laser marking unit 68, has at least one energy conversion unit 36 for operating the marking unit 16. The energy conversion unit 36 is provided to provide the laser marking elements 38, 40 with energy. The energy conversion unit 36 in this case is realized as a switched-mode power supply unit. The switched-mode power supply unit is disposed in the housing unit 14. The energy conversion unit 36, realized as a switched-mode power supply unit, can be supplied with energy by means of an electrical connection to a power cable (not represented in greater detail here) of the portable power tool 10, which power cable can be connected to an external power source, realized as a socket outlet. The power cable in this case is at the same time provided to supply the drive unit 12 with energy, by means of an electrical connection, for the purpose of driving the insert tool that can be clamped in the tool receiver 44.

For the purpose of adjusting the laser marking elements 38, 40 by means of the adjusting unit 24, the marking unit 16, realized as a laser marking unit 68, is switched on by means of a switching element 78, realized as an on/off switch, of the marking unit 16. In this case, the marking unit 16, realized as a laser marking unit 68, is supplied with energy by the energy conversion unit 36. The laser marking elements 38, 40 thus each emit one laser beam 74, 76. For the purpose of adjustment, a template 70 (FIG. 2), on which there is an adjustment crosshair 72, is disposed on the seating unit 20. It is also conceivable, however, for the seating unit 20 to have reference lines to aid adjustment of the laser marking elements 38, 40, which are disposed on a side of the seating unit 20 that faces toward the housing unit 14. After the template 70 has been disposed on the seating unit 20, in the case of deviation of a course linear laser beams 74, 76 emitted by the laser marking elements 38, 40 the linear laser beams 74, 76 emitted by the laser marking elements 38, 40 are aligned, in respect of the reference lines of the adjustment crosshair 72, substantially parallelwise in relation to reference lines (not represented in greater detail here) of the adjustment crosshair 72, by means of a rotation of the laser marking elements 38, 40 relative to the adjusting elements 26, 28 and relative to the carrier element 34.

The linear laser beams 74, 76 emitted by the laser marking elements 38, 40 are thereupon brought to coincide with the reference lines, by means of a rotation of the adjusting elements 26, 28, realized as eccentric elements, relative to the carrier element 34. Should an angular offset have occurred in this case between the linear laser beams 74, 76, emitted by the laser marking elements 38, 40, and the reference lines of the adjustment crosshair 72, the angular offset can be compensated by a further rotation of the laser marking elements 38, 40 relative to the adjusting elements 26, 28 and relative to the carrier element 34, until the linear laser beams 74, 76, emitted by the laser marking elements 38, 40, and the reference lines of the adjustment crosshair 72 coincide. Further, it is likewise conceivable that, alternatively or additionally, for the purpose of adjustment, a setting element 84 is clamped into the tool receiver 44, which setting element is provided to represent a center point about which the tool receiver 44 can be driven in rotation (FIG. 2). In this case, the linear laser beams 74, 76 emitted by the laser marking elements 38, 40 can be aligned to a tip of the setting element 84 that represents the center point, by means of a procedure already described above, in order to effect the adjustment. The setting element 84 in this case can be realized as an adjusting arbor. After a successful adjustment of the laser marking elements 38, 40, the laser marking elements 38, 40 and the adjusting elements 26, 28 are fixed in a position relative to the housing unit 14 and relative to the carrier element 34, by means of fixing elements 80, 82 of the adjusting unit 24 (FIGS. 2 and 3). The fixing elements 80, 82 are realized as setscrews. It is also conceivable, however, for the fixing elements 80, 82 to be of a different design, considered appropriate by persons skilled in the art. When mounted, the laser marking elements 38, 40 and the adjusting elements 26, 28 project at least partially out of the housing unit 14, in the direction of the seating unit 20. It is also conceivable, however, for the laser marking elements 38, 40 and/or the adjusting elements 26, 28 to be flush with a surface of the side 46 of the housing unit 14 that faces toward the seating unit 20.

During machining of a workpiece by means of the portable power tool 10, in order to remove workpiece particles the housing unit 14 is moved contrary to spring forces of spring elements (not represented in greater detail here) of the guide unit 22 in the direction of the seating unit 20, until a desired cutting depth, set previously by means of the milling depth coarse setting unit 48, has been attained. The spring elements in this case are disposed in the guide elements 62, 64, in a manner already known to persons skilled in the art. After the desired cutting depth has been attained, the housing unit 14 is fixed in a position, relative to the seating unit 20, by means of a clamping element (not represented in greater detail here) assigned to the guide elements 62, 64, in a manner already known to persons skilled in the art. The cutting depth can then be readjusted, if necessary, by means of the milling depth fine setting unit 58. During the movement of the housing unit 14 in the direction of the seating unit 20, the housing unit 14 is guided by means of the guide unit 22.

What is claimed is:

1. A portable power tool, comprising:

a tool receiver configured to receive an insert tool;

at least one drive unit configured to drive the tool receiver;

at least one housing unit in which the drive unit is disposed;

at least one seating unit configured to seat on a workpiece, the seating unit including at least two reference lines based on an incidence point of a drive axis of the tool receiver on a workpiece to be machined; and at least one marking unit configured to mark a relative position of the incidence point of the drive axis of the tool receiver on the workpiece to be machined, wherein the marking unit is disposed on a side of the housing unit that faces toward the seating unit, such that the marking unit illuminates the reference lines, wherein the marking unit is disposed on the housing unit, and wherein the portable power tool is a router.

2. The portable power tool according to claim 1, further comprising at least one guide unit by which the housing unit, together with the marking unit, is mounted so as to be movable relative to the seating unit.

3. The portable power tool according to claim 1, further comprising at least one adjusting unit having at least one movably mounted adjusting element configured to adjust a position of at least one marking element of the marking unit, the at least one marking element being movably mounted on the at least one adjusting element.

4. The portable power tool according to claim 3, wherein the adjusting element is movably mounted on a carrier element of the marking unit.

5. The portable power tool according to claim 1, wherein the marking unit has at least one energy conversion unit configured to operate the marking unit.

6. The portable power tool according to claim 5, wherein the energy conversion unit is configured as a switched-mode power supply unit.

7. The portable power tool according to claim 1, wherein the marking unit is configured as a laser marking unit.

8. The portable power tool according to claim 7, wherein the laser marking unit has at least two laser marking elements which are configured as line lasers.

9. The portable power tool according to claim 8, wherein the laser marking elements are disposed along a circumferential direction running in a plane extending at least substantially perpendicularly in relation to the drive axis and offset relative to each other by an angle other than 180° C. on the housing unit.

10. The portable power tool according to claim 1, wherein the at least one housing unit at least partially surrounds the at least one marking unit.

11. The portable power tool according to claim 3, wherein the at least one marking element is translationally movable relative to the at least one adjusting element or pivotally movable relative to the at least one adjusting element.

12. The portable power tool according to claim 3, wherein the at least one adjusting element is mounted to the at least one adjusting unit in a translationally movable manner, such that translational movement of the at least one adjusting element relative to the at least one adjusting unit compensates for an axial offset of the relative position marked by the at least one marking unit.

13. The portable power tool according to claim 3, wherein the at least one adjusting element is an eccentric element configured to move the at least one marking element eccentrically relative to a rotation axis of the at least one adjusting element.

14. The portable power tool according to claim 3, wherein the at least one adjusting element is mounted to the at least one adjusting unit in a pivotally movable manner, such that pivotal movement of the at least one adjusting element relative to the at least one adjusting unit compensates for an axial offset of the relative position marked by the at least one marking unit.

15. The portable power tool according to claim 3, wherein the at least one adjusting element is mounted to the at least one adjusting unit in a pivotally movable manner, such that pivotal movement of the at least one adjusting element relative to the at least one adjusting unit compensates for an axial offset of the relative position marked by the at least one marking unit caused by tolerances or mounting of the at least one marking unit on the housing unit.

* * * * *